US010568173B1

(12) United States Patent
Hsu et al.

(10) Patent No.: US 10,568,173 B1
(45) Date of Patent: Feb. 18, 2020

(54) DIMMER CIRCUIT FOR USE IN LIGHT-EMITTING DIODE LIGHTING SYSTEM

(71) Applicant: Chiplight Technology (Shenzhen) Co., Ltd., Shenzhen, Guangdong Province (CN)

(72) Inventors: Horng-Bin Hsu, Taipei (TW); Pen-Li Chou, Taipei (TW)

(73) Assignee: Chiplight Technology (Shenzhen) Co., Ltd., Shenzhen, Guangdong Province (CN)

( * ) Notice: Subject to any disclaimer, the term of this patent is extended or adjusted under 35 U.S.C. 154(b) by 0 days.

(21) Appl. No.: 16/231,317

(22) Filed: Dec. 21, 2018

(51) Int. Cl.
*H05B 33/08* (2006.01)
*H05B 37/02* (2006.01)

(52) U.S. Cl.
CPC ..... *H05B 33/0845* (2013.01); *H05B 33/0815* (2013.01); *H05B 37/0281* (2013.01)

(58) Field of Classification Search
CPC ..... H05B 33/0815; H05B 33/0818; H05B 37/0845; H05B 33/0884; H05B 33/0809; H05B 33/0848; H05B 33/0896; H05B 37/0245; H05B 37/0254; H05B 33/0863; H05B 33/0872; H05B 33/0803; H05B 37/0272; H05B 33/0857; H05B 33/0887
See application file for complete search history.

(56) References Cited

U.S. PATENT DOCUMENTS

2003/0201734 A1* 10/2003 Krieger ..... H05B 39/047 315/291
2006/0022611 A1* 2/2006 Rodriguez ..... H05B 39/00 315/245
2008/0224629 A1* 9/2008 Melanson ..... H05B 33/0815 315/247
2011/0248650 A1* 10/2011 Sterling ..... B25F 5/021 315/307
2012/0043889 A1* 2/2012 Recker ..... H05B 33/0815 315/86
2012/0181946 A1* 7/2012 Melanson ..... H03K 17/18 315/247
2013/0193864 A1* 8/2013 Angeles ..... H05B 33/0842 315/210
2014/0176016 A1* 6/2014 Li ..... H05B 33/0803 315/307
2015/0084529 A1* 3/2015 Otake ..... H02M 7/06 315/200 R
2015/0271894 A1* 9/2015 Torre ..... H05B 37/02 315/291

(Continued)

FOREIGN PATENT DOCUMENTS

TW M399572 U1 3/2011
TW I420972 B 12/2013

(Continued)

*Primary Examiner* — Alexander H Taningco
*Assistant Examiner* — Syed M Kaiser
(74) *Attorney, Agent, or Firm* — Winston Hsu

(57) ABSTRACT

A dimmer circuit is used in an LED lighting system which includes a power supply circuit and a lamp. The power supply circuit is configured to provide an AC voltage. The lamp is coupled to the power supply. The dimmer circuit is configured to adjust the brightness of the lamp according to a dimming signal without the lamp conducting a bleeder current during each cycle of the AC voltage.

3 Claims, 6 Drawing Sheets

(56) References Cited

U.S. PATENT DOCUMENTS

| | | | | |
|---|---|---|---|---|
| 2016/0066386 | A1* | 3/2016 | Catalano | H05B 33/0854 315/309 |
| 2016/0183340 | A1* | 6/2016 | Lee | H05B 33/0809 315/186 |
| 2016/0255425 | A1* | 9/2016 | Polster | H04Q 11/0005 398/45 |
| 2018/0160497 | A1* | 6/2018 | Lee | H05B 33/0824 |
| 2018/0368224 | A1 | 12/2018 | Eum | |
| 2019/0104583 | A1* | 4/2019 | Konishi | H05B 33/0815 |

FOREIGN PATENT DOCUMENTS

| | | | |
|---|---|---|---|
| TW | 201410069 | A | 3/2014 |
| TW | I458389 | B | 10/2014 |

* cited by examiner

DIMMER CIRCUIT FOR USE IN LIGHT-EMITTING DIODE LIGHTING SYSTEM

BACKGROUND OF THE INVENTION

1. Field of the Invention

The present invention is related to a dimmer circuit, and more particularly, to a dimmer circuit for use in an LED lighting system without any compatibility issue.

2. Description of the Prior Art

A dimmable light-emitting diode (LED) lighting system often uses a phase-cut dimmer that employ a TRIAC (triode for alternative current) device to regulate the power delivered to an LED lamp by conducting only during a certain period of an alternative-current (AC) voltage supplied to the TRIAC. Unlike other switching elements such as BJTs or MOSFETs, the TRIAC will latch-on once it is energized (after forward current $I_F$ exceeds latching current $I_L$) and continue to conduct until the forward current $I_F$ drops below a minimum holding current $I_H$. To maintain the TRIAC in the conducting state, the minimum holding current $I_H$ needs to be supplied to the TRIAC. At turn-on, an LED load presents relatively high impedance, so input current may not be sufficient to latch the TRIAC in the phase-cut dimmer. When the current through the TRIAC is less than the minimum holding current $I_H$, the TRIAC resets and prematurely turns off the dimmer. As a result, the LED lamp may prematurely turn off when it should be on, which may result in a perceivable light flicker or complete failure in the LED lighting system.

Therefore, a bleeder circuit is used to provide a bleeder current for voltage management and preventing the dimmer from turning off prematurely. However, since the LED lamp is required to conduct the bleeder current at all time, it consumes extra power and lowers system efficiency. In addition, the operation of the dimmer switch and the LED lamp may interfere with each other and cause flicker, especially at low dimming level. Many retrofit LED lamps are sold in two versions: dimmable and non-dimmable. The user needs to choose the correct type of integral LED lamp for use in a dimmable LED lighting system or in a non-dimmable LED lighting system. A non-dimmable LED lamp should not be used in an LED lighting system which employs a prior art phase-cut dimmer as it may cause obvious flickering.

SUMMARY OF THE INVENTION

The present invention provides a dimmer circuit for use in an LED lighting system which includes a power supply circuit and a lamp. The power supply circuit is configured to provide an AC voltage for driving the lamp. The dimmer circuit is configured to adjust a brightness of the lamp according to a dimming signal without the lamp supplying a bleeder current during each cycle of the AC voltage.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
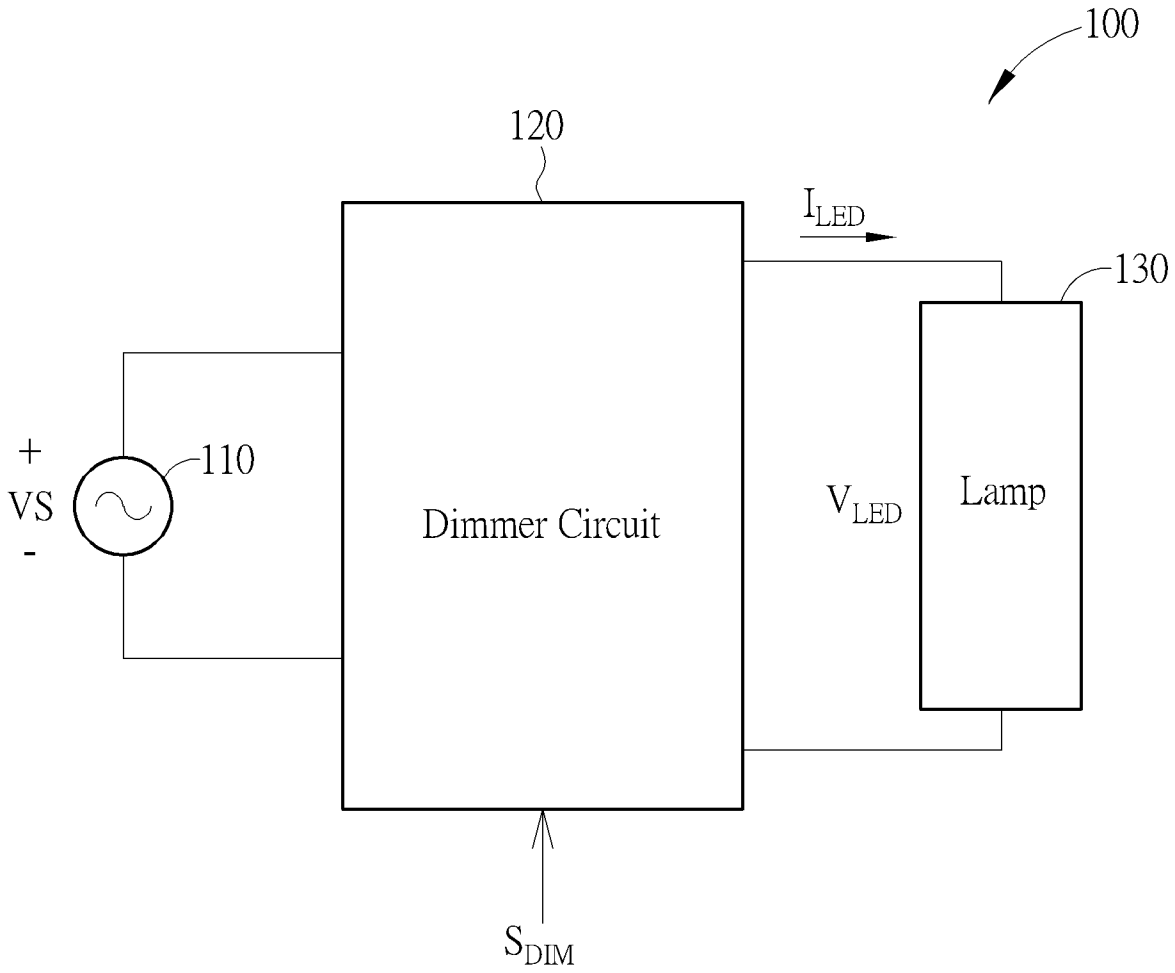
FIG. 1 is a functional diagram of an LED lighting system which adopts a dimmer circuit according to an embodiment of the present invention.

FIG. 1 is a functional diagram of an LED lighting system 100 which adopts a dimmer circuit 120 according to an embodiment of the present invention. The LED lighting system 100 includes a power supply circuit 110, and a lamp 130. The power supply circuit 110 may be an alternative current (AC) mains which provides an AC voltage VS having positive and negative periods for supplying operation power to the dimmer circuit 120. However, the configuration of the power supply circuit 110 does not limit the scope of the present invention.

The lamp 130 may include one or multiple LEDs and an LED driver. The lamp 130 may be a dimmable integral LED lamp or a non-dimmable integral LED lamp. However, the type and configuration of the lamp 130 do not limit the scope of the present invention.

The dimmer circuit 120 is configured to adjust the brightness of the lamp 130 according to a dimming signal $S_{DIM}$, which may be a pulse-width-modulation (PWM) signal, a direct-current (DC) signal or an inter-integrated circuit (I2C) signal. The dimming operation may be performed by converting the AC voltage VS into a rectified AC voltage $V_{AC}$ whose value varies periodically with time for driving the lamp 30, by adjusting the phase-cut period of the voltage $V_{LED}$ established across the lamp 130, by adjusting the level of the voltage $V_{LED}$, or by adjusting the current $I_{LED}$ flowing through the lamp 130. In the present invention, since the operation power of the dimmer circuit 120 is supplied by the power supply circuit 110, the lamp 130 is not required to always conduct a bleeder current. Since the phase-cut operation of the dimmer circuit 120 is independent of that of the lamp 130, the present dimmer circuit 120 may be applied to all types of lamps including, but not limited to, dimmable integral LED lamps or non-dimmable integral LED lamps without any compatibility issue.

Figure 2:
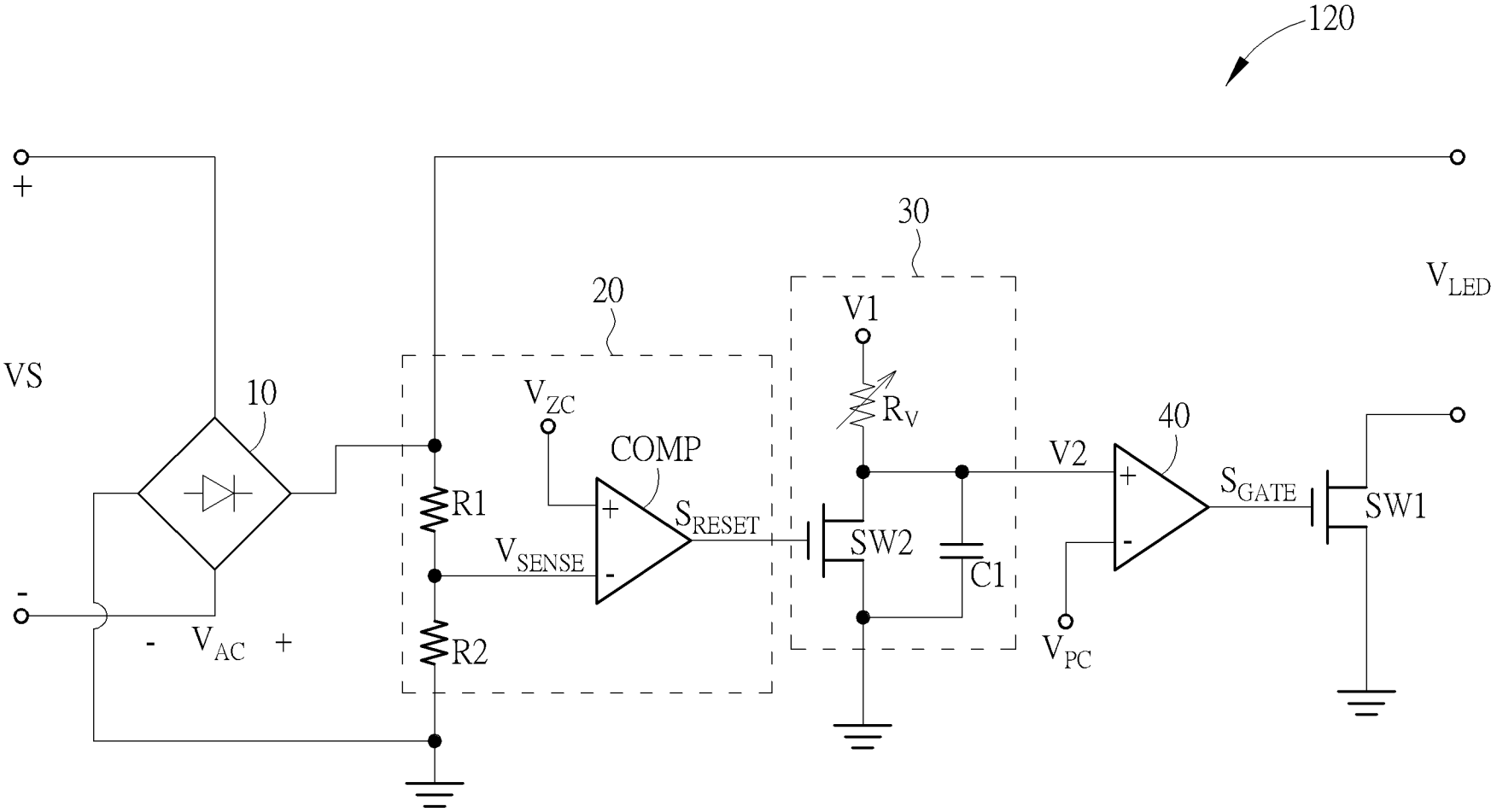
FIG. 2 is a diagram illustrating the implementation of a dimmer circuit in the LED lighting system according to an embodiment of the present invention.
Figure 3:
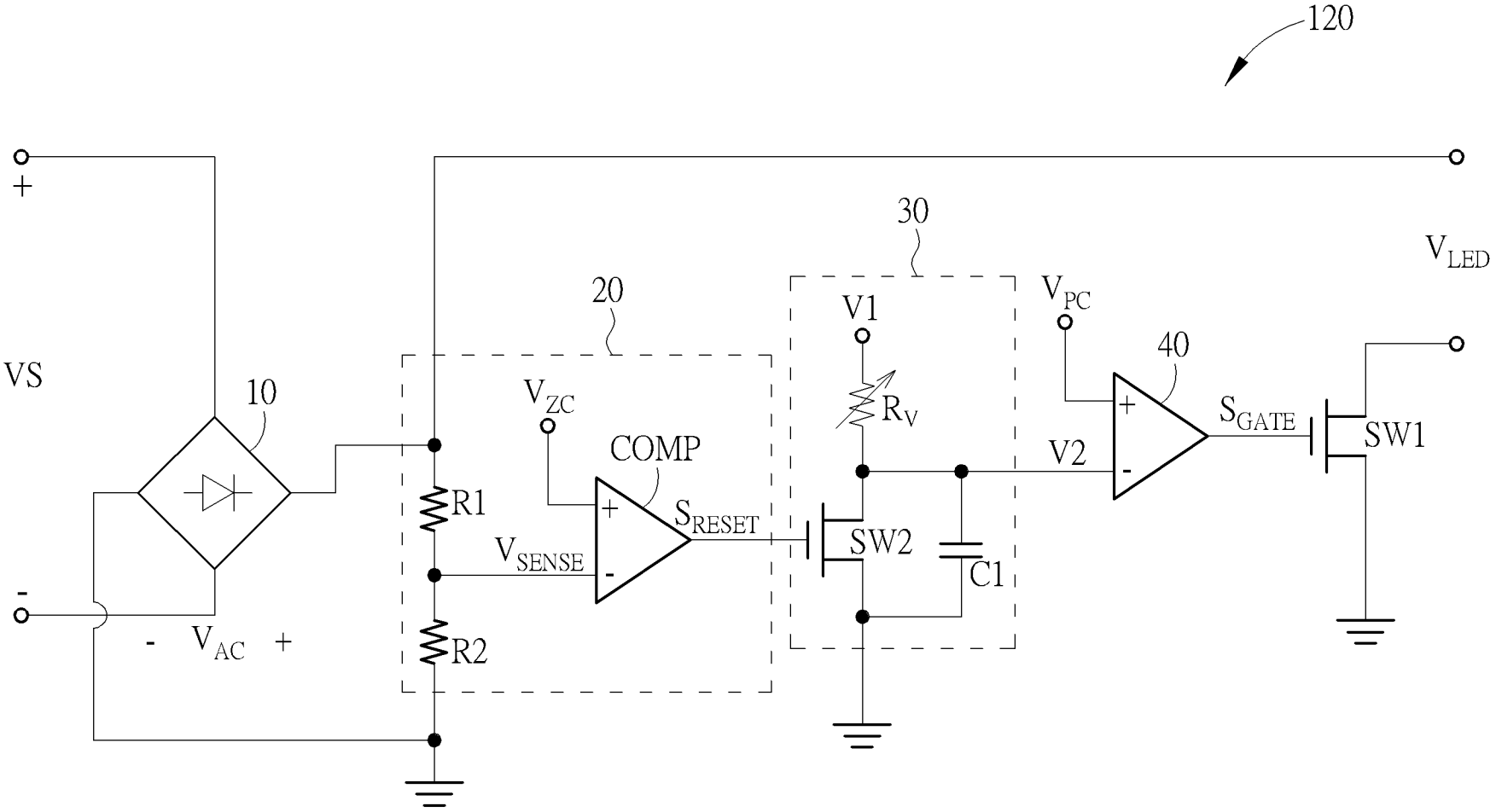
FIG. 3 is a diagram illustrating the implementation of a dimmer circuit in the LED lighting system according to another embodiment of the present invention.

FIGS. 2 and 3 are diagrams illustrating the implementation of the dimmer circuit 120 in the LED lighting system 100 according to embodiments of the present invention. In these embodiments, the dimmer circuit 120 includes a bridge rectifier 10, a zero-cross detection circuit 20, a timing circuit 30, a gate driver 40, and a switch SW1. The bridge rectifier 10 is configured to convert the AC voltage VS into a rectified AC voltage $V_{AC}$ whose value varies periodically with time. The zero-cross detection circuit 20 is configured to detect a zero-cross level of the rectified AC voltage $V_{AC}$. The timing circuit 30 is configured to determine the length of the phase-cut period of the voltage $V_{LED}$ established across the lamp 130 based on the dimming signal $S_{DIM}$. The gate driver 40 is configured to output an enable signal $S_{GATE}$ according to the length of the phase-cut period of the voltage $V_{LED}$. The switch SW1 is configured to supply the rectified AC voltage $V_{AC}$ to the lamp 130 or cut off the rectified AC voltage $V_{AC}$ from the lamp 130 according to the enable signal $S_{GATE}$.

In the embodiments illustrated in FIGS. 2 and 3, the zero-cross detection circuit 20 includes resistors R1-R2 and a comparator COMP. The resistors R1-R2 form a voltage-dividing circuit which senses the level of the rectified AC voltage $V_{AC}$ and provides a corresponding sensing voltage $V_{SENSE}$. The comparator COMP includes a positive input end coupled to a predetermined reference voltage $V_{ZC}$, a negative input end coupled between the resistors R1 and R2 for receiving the sensing voltage $V_{SENSE}$, and an output end for outputting a reset signal $S_{RESET}$. During a cycle when the sensing voltage $V_{SENSE}$ associated with the rectified AC voltage $V_{AC}$ is larger than the zero-cross level defined by the reference voltage $V_{ZC}$, the comparator COMP is configured to output a reset signal $V_{RESET}$ of a first level for enabling the timing circuit 30. During a cycle when the sensing voltage $V_{SENSE}$ associated with the rectified AC voltage $V_{AC}$ is not larger than the reference voltage $V_{ZC}$, the comparator COMP is configured to output a reset signal $V_{RESET}$ of a second level for resetting the timing circuit 30.

In the embodiment illustrated in FIG. 2, the timing circuit 30 includes a variable resistor Rv, a capacitor C1, and a reset switch SW2, while the gate driver 40 may be implemented using a comparator. The gate driver 40 includes a positive input end coupled to the variable resistor Rv and the capacitor C1, a negative input end coupled a predetermined reference voltage $V_{PC}$, and an output end for outputting an enable signal $S_{GATE}$. The capacitor C1 is charged by a constant voltage V1 through the variable resistor Rv, thereby providing a corresponding voltage V2 at the positive input end of the gate driver 40. When the voltage V2 is not larger than the phase-cut reference voltage $V_{PC}$, the gate driver 40 is configured to output an enable signal $S_{GATE}$ of a third level, thereby turning off the switch SW1 for cutting off the rectified AC voltage $V_{AC}$ from the lamp 130. When the voltage V2 is larger than the phase-cut reference voltage $V_{PC}$, the gate driver 40 is configured to output an enable signal $S_{GATE}$ of a fourth level, thereby turning on the switch SW1 for supplying the rectified AC voltage $V_{AC}$ to the lamp 130. The reset switch SW2 includes a first end coupled to a first end of the capacitor C1, a second end coupled to a second end of the capacitor C1, and a control end coupled to receive the reset signal $S_{RESET}$. As previously stated, during the cycle when the sensing voltage $V_{SENSE}$ associated with the rectified AC voltage $V_{AC}$ is not larger than the reference voltage $V_{ZC}$, the reset switch SW2 is turned on by the reset signal $S_{RESET}$ of the first level, thereby shunting the voltage V1 and allowing the capacitor C1 to discharge. During the cycle when the sensing voltage $V_{SENSE}$ associated with the rectified AC voltage $V_{AC}$ is larger than the reference voltage $V_{ZC}$, the reset switch SW2 is turned off by the reset signal $S_{RESET}$ of the second level, thereby allowing the capacitor C1 to be charged by the voltage V1.

In the embodiment illustrated in FIG. 3, the timing circuit 30 includes a variable resistor Rv, a capacitor C1, and a reset switch SW2, while the gate driver 40 may be implemented using a comparator. The gate driver 40 includes a positive input end coupled a predetermined reference voltage $V_{PC}$, a negative input end coupled to the variable resistor Rv and the capacitor C1, and an output end for outputting an enable signal $V_{GATE}$. The capacitor C1 is charged by a constant voltage V1 through the variable resistor Rv, thereby providing a corresponding voltage V2 at the negative input end of the gate driver 40. When the voltage V2 is not larger than the reference voltage $V_{PC}$, the gate driver 40 is configured to output an enable signal $S_{GATE}$ of a fifth level, thereby turning on the switch SW1 for supplying the rectified AC voltage $V_{AC}$ to the lamp 130. When the voltage V2 is larger than the reference voltage $V_{PC}$, the gate driver 40 is configured to output an enable signal $S_{GATE}$ of a sixth level, thereby turning off the switch SW1 for cutting off the rectified AC voltage $V_{AC}$ from the lamp 130. The reset switch SW2 includes a first end coupled to a first end of the capacitor C1, a second end coupled to a second end of the capacitor C1, and a control end coupled to receive the reset signal $S_{RESET}$. As previously stated, during the cycle when the sensing voltage $V_{SENSE}$ associated with the rectified AC voltage $V_{AC}$ is not larger than the reference voltage $V_{ZC}$, the reset switch SW2 is turned on by the reset signal $S_{RESET}$ of the first level, thereby shunting the voltage V1 and allowing the capacitor C1 to discharge. During the cycle when the sensing voltage $V_{SENSE}$ associated with the rectified AC voltage $V_{AC}$ is larger than the reference voltage $V_{ZC}$, the reset switch SW2 is turned off by the reset signal $S_{RESET}$ of the second level, thereby allowing the capacitor C1 to be charged by the voltage V1.

In the embodiments depicted in FIGS. 2 and 3, the dimmer circuit 120 is configured to cut the phase of the AC voltage VS so as to disable the lamp 130 during a phase-cut period in a cycle. More specifically, the lamp 130 is only activated during a turn-on period $T_{ON}$ of in cycle of the voltage $V_{LED}$ and is deactivated during a phase-cut period $T_{PC}$ in a cycle of the voltage $V_{LED}$. Dimming operation can thus be performed by adjusting the length of the phase-cut period $T_{PC}$.

Figure 4:
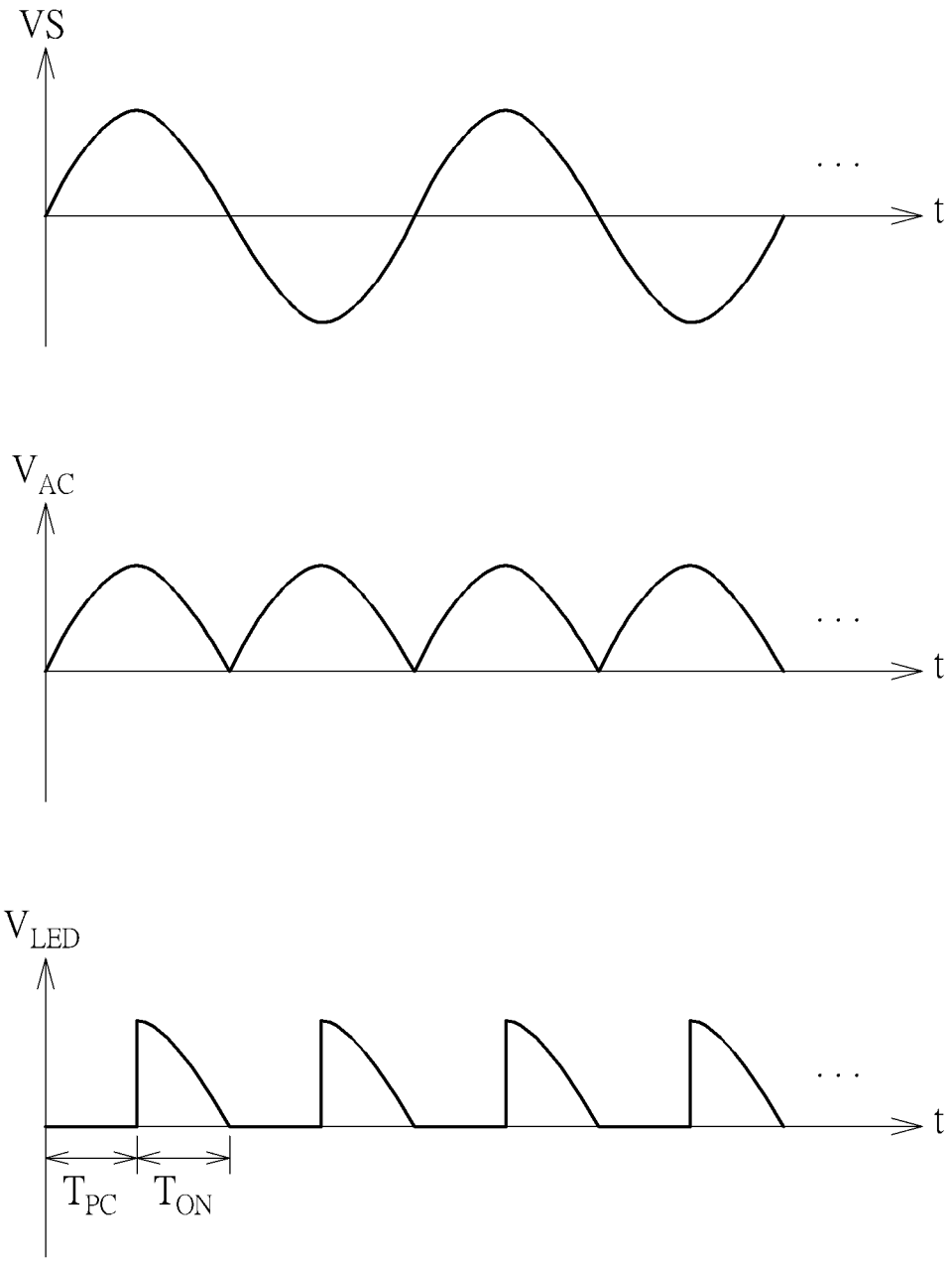
FIG. 4 is a diagram illustrating the operation of the dimmer circuit depicted in FIG. 2 according to an embodiment of the present invention.
Figure 5:
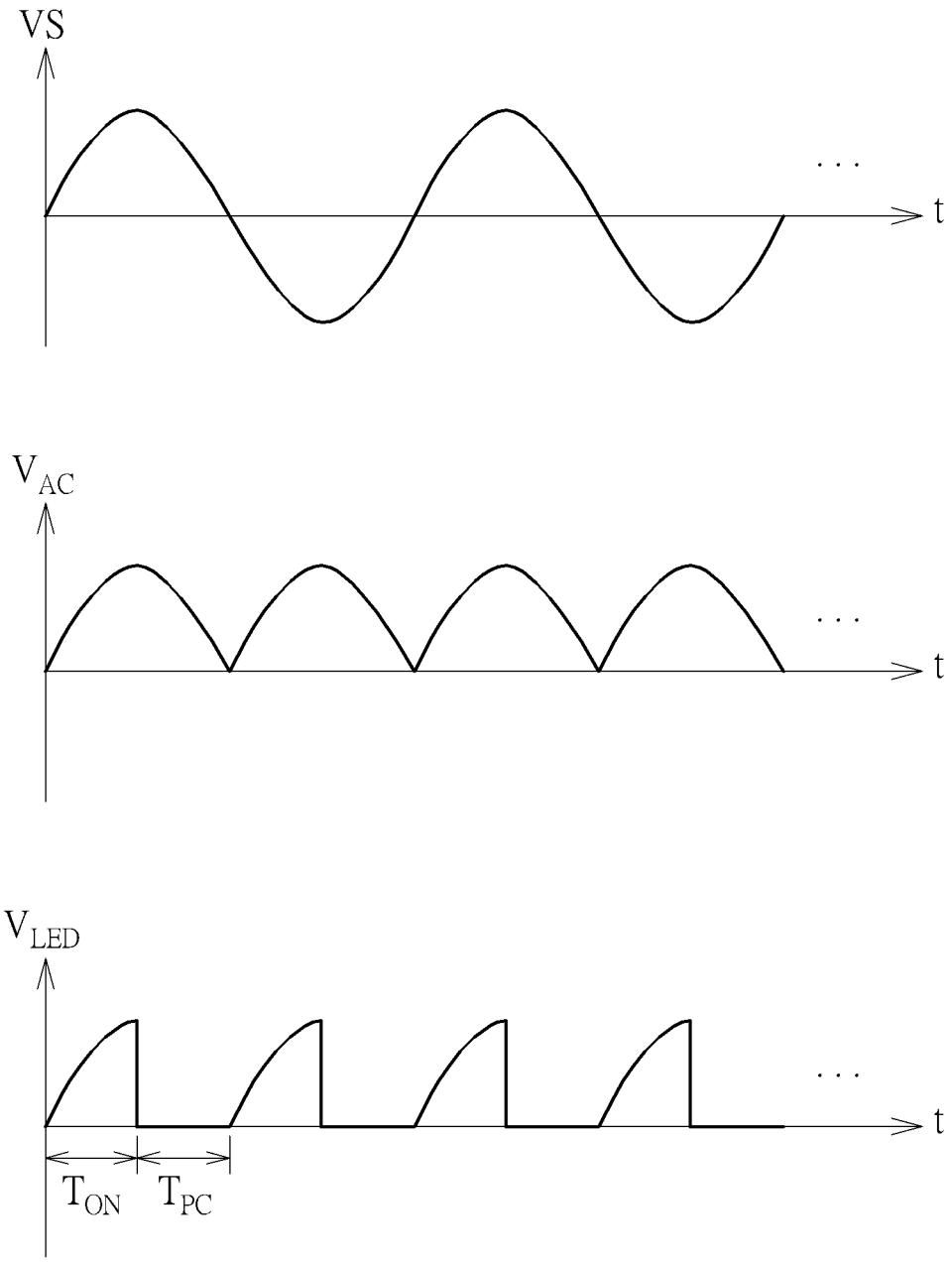
FIG. 5 is a diagram illustrating the operation of the dimmer circuit depicted in FIG. 3 according to an embodiment of the present invention.

FIG. 4 is a diagram illustrating the operation of the dimmer circuit 120 depicted in FIG. 2 according to an embodiment of the present invention. FIG. 5 is a diagram illustrating the operation of the dimmer circuit 120 depicted in FIG. 3 according to an embodiment of the present invention. In the embodiment depicted in FIGS. 2 and 4, the dimmer circuit 120 is configured to perform phase-cut dimming on the rising edge of the rectified AC voltage $V_{AC}$. In the embodiment depicted in FIGS. 3 and 5, the dimmer circuit 120 is configured to perform phase-cut dimming on the falling edge of the rectified AC voltage $V_{AC}$. The length of the phase-cut period $T_{PC}$ of the LED lighting system 100 may be adjusted by adjusting the value of the variable resistor Rv.

Figure 6:
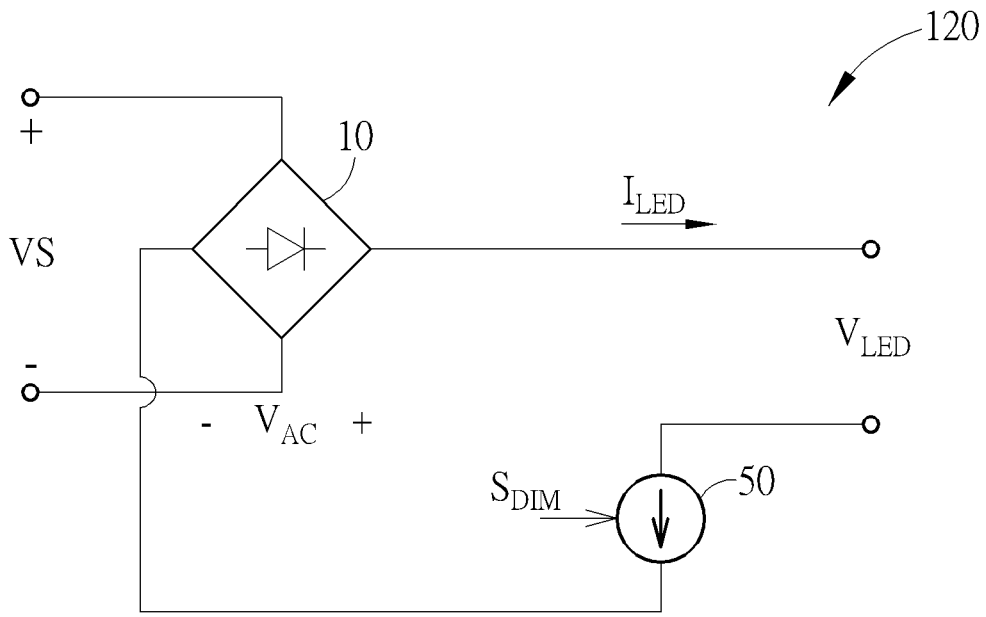
FIG. 6 is a diagram illustrating the implementation of a dimmer circuit in the LED lighting system according to another embodiment of the present invention.

FIG. 6 is a diagram illustrating the implementation of the dimmer circuit 120 in the LED lighting system 100 according to another embodiment of the present invention. In this embodiment, the dimmer circuit 120 includes a bridge rectifier 10 and a constant current regulator 50. The bridge rectifier 10 is configured to convert the AC voltage VS into a rectified AC voltage $V_{AC}$ whose value varies periodically with time. The constant current regulator 50 is configured to limit the current $I_{LED}$ flowing through the lamp 130 to a value indicated by a dimming signal $S_{DIM}$, which may be a PWM signal, a DC signal or an I2C signal. Dimming operation can be performed by $I_{LED}$ increasing or decreasing the current for adjusting the brightness of the lamp 130. In another embodiment, the dimmer circuit 120 may further include a capacitor coupled in parallel with the lamp 130 for further reducing flicker. In yet another embodiment, the dimmer circuit 120 may further include a capacitor coupled in parallel with the luminescent devices in the lamp 130 for further reducing flicker.

Figure 7:
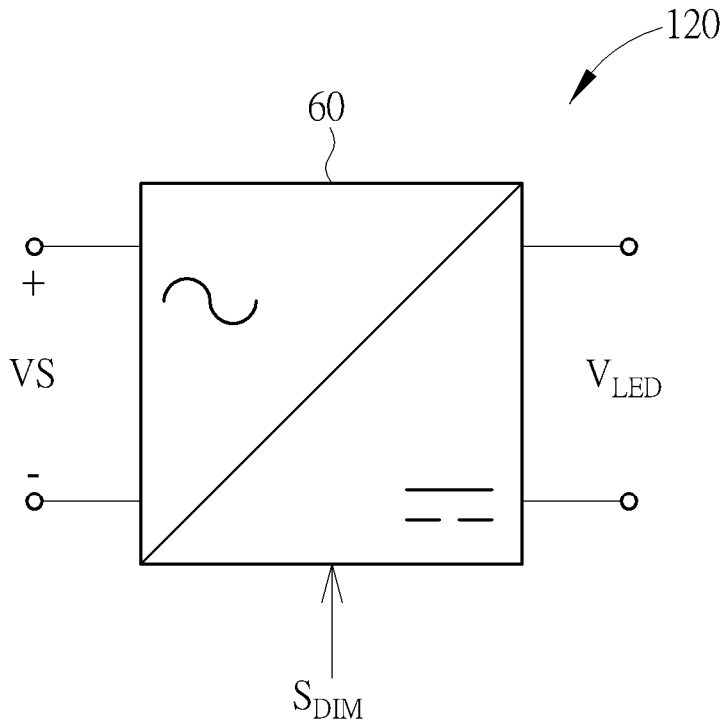
FIG. 7 is a diagram illustrating the implementation of a dimmer circuit in the LED lighting system according to another embodiment of the present invention.

FIG. 7 is a diagram illustrating the implementation of the dimmer circuit 120 in the LED lighting system 100 according to another embodiment of the present invention. In this embodiment, the dimmer circuit 120 includes an AC-DC converter 60. The AC-DC converter 60 is configured to convert the AC voltage VS into one of multiple DC voltages indicated by a dimming signal $S_{DIM}$, which may be a PWM signal, a DC signal or an I2C signal. Dimming operation can be performed by regulating the voltage $V_{LED}$ established across the lamp 130. In another embodiment, the dimmer circuit 120 may further include a capacitor coupled in parallel with the lamp 130 for further reducing flicker. In yet another embodiment, the dimmer circuit 120 may further include a capacitor coupled in parallel with the luminescent devices in the lamp 130 for further reducing flicker.

In conclusion, the present invention provides a dimmer circuit for use in an LED lighting system. The operation of the dimmer circuit is independent of a lamp of the LED lighting system. Therefore, the luminescent unit is not required to always supply a bleeder current to sustain the dimming operation, thereby reducing power consumption and improving system efficiency.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A dimmer circuit for use in a light-emitting diode (LED) lighting system which comprises a power supply circuit configured to provide an alternating current (AC) voltage and a lamp driven by the AC voltage, and configured to:

adjust a brightness of the lamp according to a dimming signal without the lamp supplying a bleeder current during each cycle of the AC voltage; and adjust the brightness of the lamp by adjusting a length of a phase-cut period of a voltage established across the lamp according to the dimming signal, wherein the lamp is deactivated during the phase-cut period;

the dimmer circuit comprising:

a bridge rectifier configured to convert the AC voltage into a rectified AC voltage;

a zero-cross detection circuit configured to detect a zero-cross level of the rectified AC voltage and comprising:

a first resistor and a second resistor coupled in series between the rectified AC voltage and a bias voltage; and a comparator including:

a positive input end coupled to a first reference voltage associated with the zero-cross level of the rectified AC voltage;

a negative input end coupled between the first resistor and the second resistor for receiving a sensing voltage; and an output end for outputting a reset signal having a level associated with a relationship between the sensing voltage and the first reference voltage;

a timing circuit configured to determine the length of the phase-cut period according to the dimming signal and comprising:

a variable resistor;

a capacitor having a first end and a second end; and a reset switch including:

a first end coupled to the first end of the capacitor;

a second end coupled to the second end of the capacitor; and a control end coupled to receive the reset signal;

a gate driver configured to output an enable signal according to the length of the phase-cut period and comprising:

a first input end coupled to a first voltage via the variable resistor;

a second input end coupled to a second reference voltage; and an output end for outputting an enable signal having a level associated with a relationship between the second reference voltage and a voltage established at the first input end of the gate driver; and a switch configured to supply the rectified AC voltage to the lamp or cut off the rectified AC voltage from the lamp according to the enable signal.

2. The dimmer circuit of claim 1, further comprising a capacitor coupled in parallel with the lamp.

3. The dimmer circuit of claim 1, wherein:

the lamp includes:

a plurality of luminescent devices coupled in series; and a current regulator coupled in series to the plurality of luminescent devices; and the dimmer circuit includes a capacitor coupled in parallel with the plurality of luminescent devices.

* * * * *